US005921351A

United States Patent [19]

Schröder-Brumloop

[11] Patent Number: 5,921,351

[45] Date of Patent: Jul. 13, 1999

[54] MODULAR DRIVE MECHANISM FOR A PASSENGER CONVEYOR

[75] Inventor: Helmut L. Schröder-Brumloop, Ville d'Avray, France

[73] Assignee: Otis Elevator Company, Farmington, Conn.

[21] Appl. No.: 08/840,436

[22] Filed: Apr. 29, 1997

[51] Int. Cl.[6] ..... B66B 11/08

[52] U.S. Cl. ..... 187/255; 187/270

[58] Field of Search ..... 187/255, 270, 187/266, 404, 405, 414; 182/141, 145

[56] References Cited

U.S. PATENT DOCUMENTS 3,317,005 5/1967 Kehoe ..... 187/270
5,699,879 12/1997 Sakita ..... 187/249

FOREIGN PATENT DOCUMENTS 0012149 6/1980 European Pat. Off. ..... 187/255

*Primary Examiner*—Kenneth Noland

[57] ABSTRACT

A passenger conveyor system, such as an elevator or shuttle system, includes a drive system formed from a plurality of sequentially connected belts driven by a machine. Each of the belts is engageable with a car to move the car along a portion of the path, and adjacent belts are interconnected by a transmission. In a particular embodiment, the passenger conveyor system includes a counterweight that is also engaged with the plurality of belts. In another particular embodiment, the passenger conveyor system includes a first portion in which the belt driven car moves vertically and a second portion in which the belt driven car moves horizontally.

16 Claims, 3 Drawing Sheets

FIG.1
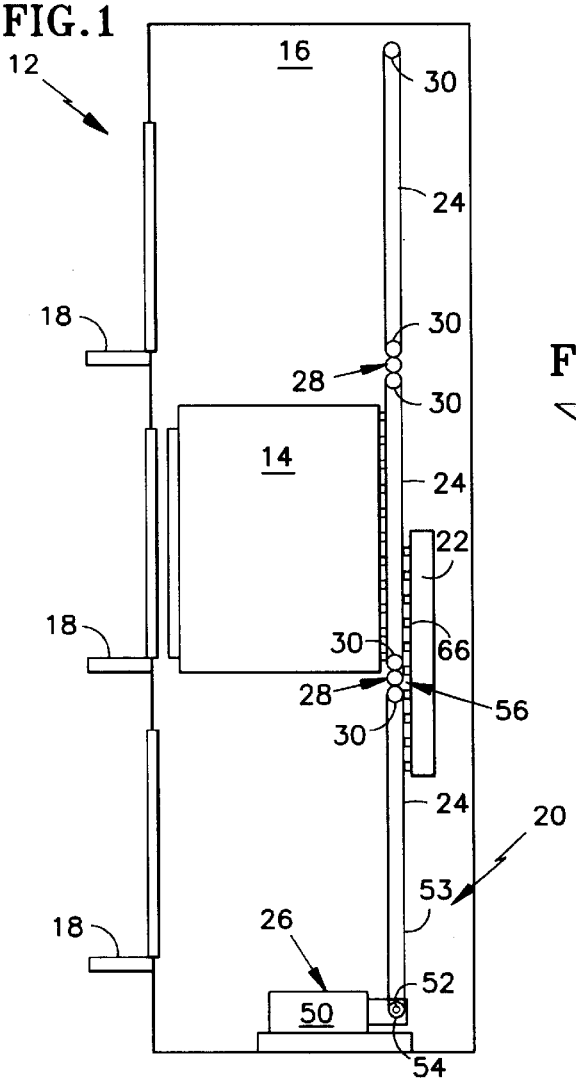
FIG.2A
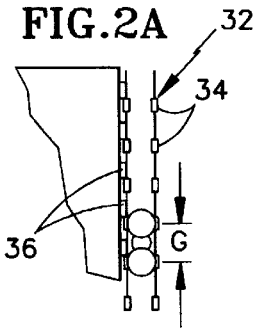
FIG.2B
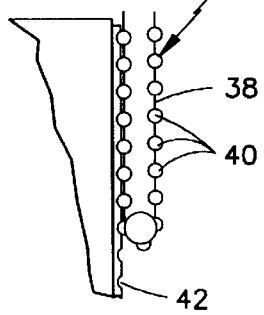
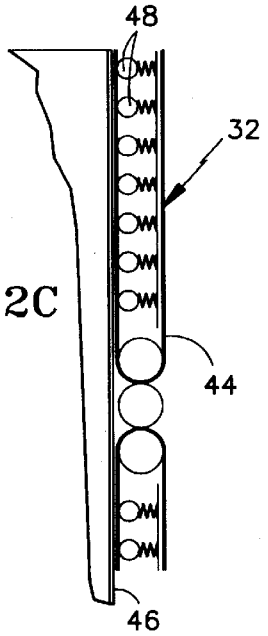
FIG.2C
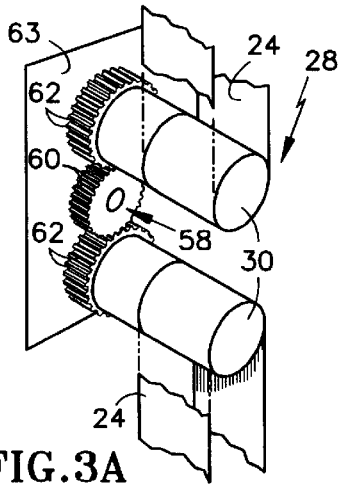
FIG.3A
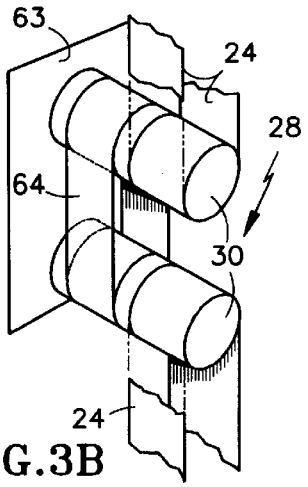
FIG.3B

MODULAR DRIVE MECHANISM FOR A PASSENGER CONVEYOR

TECHNICAL FIELD

The present invention relates to passenger conveyors such as elevators and shuttle systems, and more particularly to drive mechanisms for such passenger conveyors.

BACKGROUND OF THE INVENTION

In conventional elevators, there are various types of drives systems to select from. These systems include among them traction rope drive systems, hydraulic drive systems, and linear motor drive systems. The required rise of the elevator system is one determining factor in selecting a drive system. The latter two drive systems are significantly limited in rise due to the physical limitations of the hydraulic cylinder and the electrical stator, respectively. Rope traction systems permit much higher rises, however, they are also limited by the physical limitations of the ropes used. At a determinable length, a rope will fail under its own weight.

Another factor in the selection of the drive system for an elevator is the cost of the system. These costs include material costs, installation costs and operating costs. One suggestion to reduce the installation costs of the elevator system is to modularize the hoistway components. This has been suggested in commonly assigned European Patent Application 0 442 230. This application discloses a modular arrangement for the car guide rails, the counterweight guide rails and various other hoistway components. As a result of the modularity, much of the hoistway structure can be prefabricated and shipped to the building site for installation as a preassembled module.

The above art notwithstanding, scientists and engineers under the direction of Applicants' Assignee are working to develop improved drive mechanisms for passenger conveyors that are not subject to the conventional limitations and that minimize operating and installation costs.

DISCLOSURE OF THE INVENTION

According to the present invention, a passenger conveyor system includes a drive system formed from a plurality of sequentially connected belts driven by a machine. Each of the belts is engageable with a car to move the car along a portion of the path. Adjacent belts are interconnected by a transmission.

The configuration of a belt drive system having a plurality of sequentially connected belts results in a modular drive system. Each module is comprised of a belt and a transmission or a machine. The number of modules required depends upon the rise of the hoistway, and the rise of the hoistway is not limited by the drive system as in prior art drive systems. Another benefit of the modularity is that the costs associated with the belt drive system may be minimized by the standardization of the modules and the economic benefits of increased volumes. Such a drive system is applicable to low, medium and high rise applications.

In a particular embodiment of the present invention, the passenger conveyor system includes a counterweight that is also engaged with the plurality of belts. As a result of the common engagement of the counterweight and car with the belts, no rope is necessary to interconnect the counterweight and car. Therefore, the limitations placed on a passenger conveyor system by having ropes are eliminated.

In another particular embodiment, the passenger conveyor system includes a first portion of the path of the car that is oriented for vertical motion of the car and a second portion of the path of the car that is oriented for horizontal motion of the car. In both portions of the path, motive force for the car is provided by engagement with a plurality of sequentially connected belts. As a result, this belt drive system may used to drive vertical elevator systems, to drive horizontal shuttle systems, or systems that are a combination of both types of passenger conveyors.

In a further particular embodiment, the drive system includes a plurality of machines and a plurality of grouped, sequentially connected belts. In this configuration, the groups of belts are distributed along the path. As a result, the number of belts and transmissions associated with a particular machine may be optimized to account for losses that may occur as energy is transmitted between adjacent belts. A particular advantage of this configuration is that the machines and the groups of belts may be operationally independant. As a result, energy may be saved by not operating the machines and groups of belts that are remote from the car and therefore are not required to move the car through the path. As a further feature of this embodiment, each group of belts has an individual counterweight associated with it.

The foregoing and other objects, features and advantages of the present invention become more apparent in light of the following detailed description of the exemplary embodiments thereof, as illustrated in the accompanying drawings.

BRIEF DESCRIPTION OF THE DRAWINGS

FIG. 1 is a side view of an elevator system having a belt drive system.

FIG. 2*a* is a side view of a toothed belt engaged with the car; FIG. 2*b* is a side view of a ball rope engaged with the car; and FIG. 2*c* is a side view of a traction belt engaged with the car.

FIG. 3*a* is a perspective view of a transmission having a transfer gear disposed between adjacent belt axles; and FIG. 3*b* is a perspective view of a transmission having a synchronous belt engaged with adjacent belt axles.

BEST MODE FOR CARRYING OUT THE INVENTION

Figure 4:
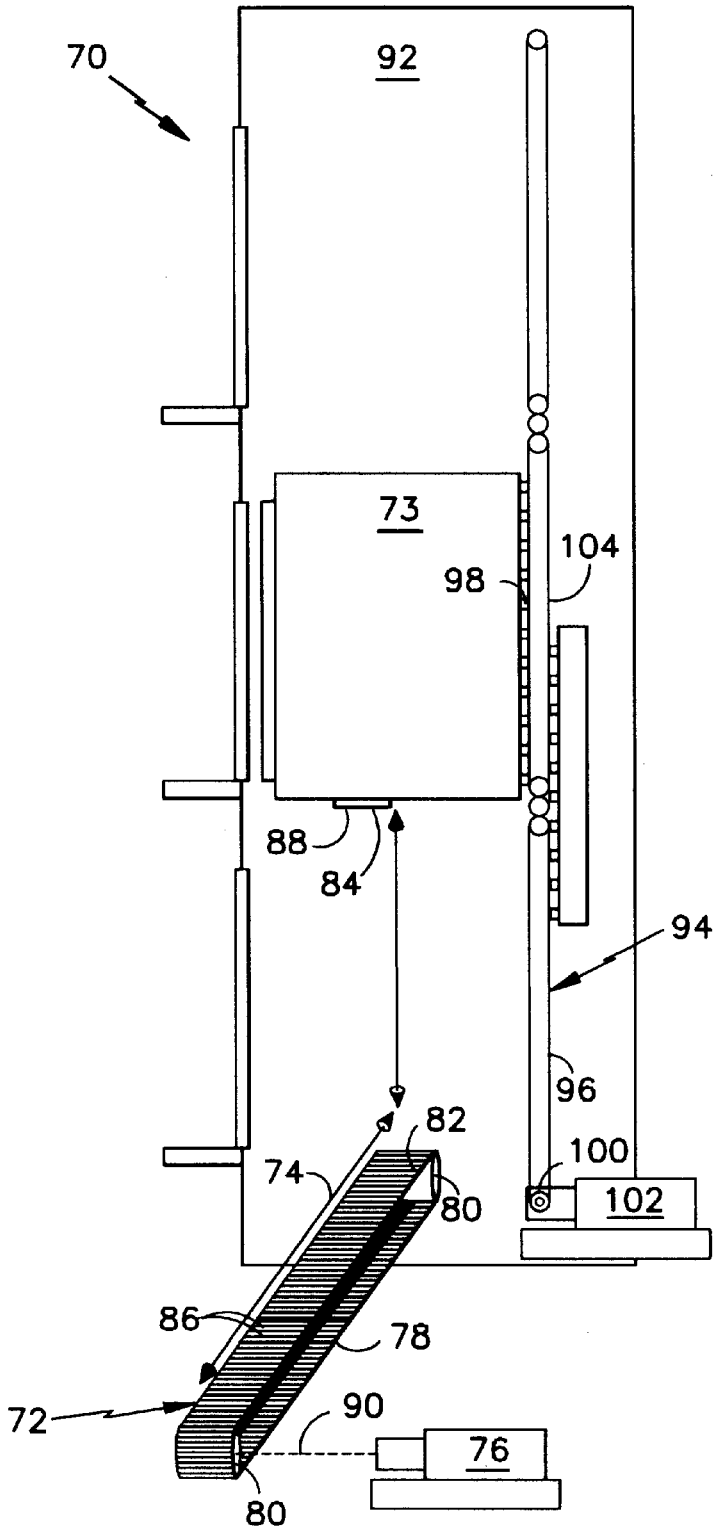
FIG. 4 is a side view of a passenger conveyor having a vertical travel path and a horizontal travel path.

Illustrated in FIG. 1 is an elevator system 12 according to the present invention. The elevator system 12 includes a car 14 traveling within a hoistway 16, a plurality of landings 18 within the hoistway 16, a drive mechanism 20 for the car 14, and a counterweight 22. As shown in FIG. 1, the drive mechanism 20 propels the car 14 through the hoistway 16 from landing 18 to landing 18, as demanded by passenger traffic, with stops at landings 18 to permit loading and unloading of passenger traffic. Other conventional components of a typical elevator system, such as guide rails for the car and the counterweight, safeties, buffers, etc., have not been shown in the illustration in FIG. 1 for the purpose of clarity. Some or all of these conventional components may be used, in any of their various configurations, with the drive mechanism 20 of the present invention.

The drive mechanism 20 includes a plurality of belts 24 that are sequentially arranged within the hoistway 16, a machine 26, and a plurality of transmissions 28 disposed between adjacent belts 24. Each of the belts 24 is engaged with a pair of rollers 30 disposed at opposite ends of the belt 24 and extends between adjacent landings 18. Although illustrated in FIG. 1 as each belt 24 extends only between adjacent landings 18, it shall be apparent to one skilled in the art that each belt 24 may extend across one or more landings.

The outwardly facing surface of each belt 24 includes means 32 to engage the car 14. As shown more clearly in FIG. 2*a*, the car engagement means 32 is defined by a plurality of spaced projections or teeth 34 that extend outwardly from the belt 24. The car 14 includes a complementary surface configuration 36 that mates with the toothed belt 24 to ensure that the motion of the belt 24 and the car 14 is coordinated during engagement of the car 14 and belt 24.

Although shown in FIGS. 1 and 2*a* as a toothed belt 24, other types of belts and engagement means may be used to engage the car. One such engagement means 32 is disclosed in FIG. 2*b*. In this embodiment, a belt 38 includes a plurality of spaced, bulbous projections 40 that are engageable with a complementary surface 42 on the car 14. Another alternative engagement means is a traction belt 44, as illustrated in FIG. 2*c*. In this configuration, the traction belt 44 is biased against a contact surface 46 on the car by a plurality of spring loaded rollers 48. The friction between the traction belt 44 and the contact surface 46 ensures that the motion of the belt 44 and the car 14 is coordinated during engagement of the car 14 and belt 44.

The drive machine 20 includes a motor 50 having an output shaft 52. The motor 50 provides means to drive the output shaft 52 that is engaged with the drive belts 24. As such, the motor 50 may be hydraulic or electric, may be an A.C. or D.C. electric motor, and may be geared or gearless, or any other means to drive the output shaft 52. In addition, although shown in FIG. 1 with the machine 20 located in the lower portion of the hoistway 16, it should be noted that the machine 20 may be located in other parts of the hoistway 16, or even in a space outside of the hoistway 16, as desired.

The first, or lowest, belt 53 includes one roller 54 that is connected to the output shaft 52 of the machine 20. The opposite roller 30 of the first belt 53 is connected to a first transmission 56, which is itself connected to one of the rollers 30 of the adjacent belt 24. The machine 20 imparts rotational motion to the first roller 54 and drives the first belt 53. Motion of the first belt 53 thereby drives the opposite roller, which in turn drives the lower roller 30 of the adjacent belt 28 via the transmission 28.

The transmission 28 is more clearly shown in FIG. 3*a*. The transmission 28 includes a transfer gear 58 having gear teeth 60 that mesh with complementary gear teeth 62 on the adjacent rollers 30 of the belts 24. The transfer gear 58 is mounted to a frame 63 in a manner permitting rotation. In this way, rotational energy is transmitted between the rollers 30, and thereby, the adjacent belts 24. An alternate embodiment of the transmission 28 is shown in FIG. 3*b*. In this embodiment, the transmission 28 includes a transfer belt 64 that is engaged with each of the rollers 30. The transfer belt 64 provides the mechanism by which rotational energy is transferred from one roller 30 to the adjacent roller 30. The engagement between the transfer belt 64 and the rollers 30 may be a conventional traction type engagement or it may be a conventional toothed belt that is engaged with complementary teeth on the adjacent rollers.

The counterweight 22 also includes a complementary surface configuration 66 that engages the plurality of belts 24 to coordinate the motion of the counterweight 22 and the belt 24 to which it is engaged. The counterweight 22 is engaged with the opposite side of the drive mechanism 20 such that the car 14 and counterweight 22 move in opposite directions. By having the counterweight 22 engaged with the belts 24, the need for a roped connection between the car 14 and counterweight 22 is eliminated, although a roped connection may still be desirable in some applications to ensure against slip between the belts 24 and the car 14 and counterweight 22.

During operation, rotation of the output shaft 52 of the machine 20 turns the first roller 54, which drives the first belt 53 and, via the transmissions 28, the remainder of the plurality of belts 24 in the drive mechanism 28. The car 14 travels through the hoistway and moves from one belt 24 to the adjacent belt 24. The length of the complementary configuration surfaces 42, 66 on the car 14 and the counterweights 22 is such that it will bridge the gap G between adjacent belts 24 (see FIG. 2*a*). In addition, relative position of the teeth 34 on adjacent belts 24 is synchronized to ensure smooth transition of the car 14 and centering between adjacent belts 24. As the car 14 is propelled through the hoistway 16, the mass of the counterweight 22 offsets the mass of the car 14 to reduce the required output of the machine.

The embodiment of FIG. 1 illustrates a passenger conveyor for vertical conveyance of passenger traffic. FIG. 4 illustrates a passenger conveyor 70 for both vertical and horizontal conveyance of passenger traffic. In this embodiment, a second drive mechanism 72 is used to drive a car 73 along its horizontal path 74. The second drive mechanism 72 includes a second machine 76 and a belt 78 that is oriented horizontally and engaged with a pair of rollers 80 disposed at opposite ends of the belt 78. The outwardly facing surface 82 of the second belt 78 includes means 84 to engage the car 73. The means 84, as shown in FIG. 4, is defined by a plurality of spaced teeth 86 that extend outward from the belt 78. The car 73 includes a second complementary surface configuration 88 that mates with the second belt 78 to ensure that the motion of the belt 78 and the car 73 is coordinated during engagement of the car 73 and second belt 78.

During operation of the combined horizontal and vertical passenger conveyor 70, rotational energy is supplied to the horizontal belt 78 by the second machine 76 via an output shaft 90. The moving belt 78 propels the car 73 horizontally through the engagement between the second complementary surface configuration 88 and the outwardly facing surface 82 of the second belt 78. Once the car 73 has reached the hoistway 92, it is engaged with a vertically oriented drive mechanism 94, which is similar to the drive mechanism 20 of FIG. 1. The first belt 96 is engaged with the complementary surface configuration 98 and rotational energy is supplied to the first roller 100 via the machine 102. The movement of the first belt 96 propels the car 73 vertically through the hoistway 92 until the car 73 engages the next belt 104. The remainder of the operation of the vertically oriented drive mechanism 94 is the same as the operation of the embodiment disclosed in FIG. 1.

Figure 5:
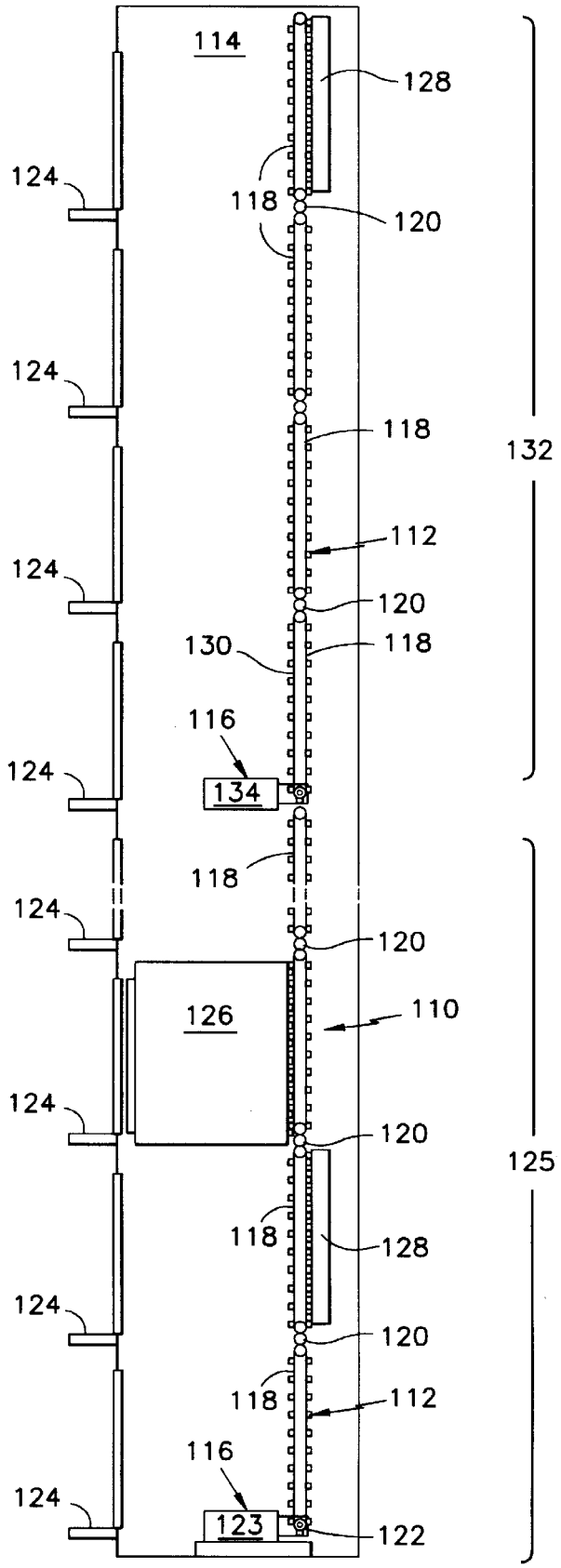
FIG. 5 is a side view of an elevator system having a plurality of independantly operated machines and groups of belts distributed along the travel path of the car.

In another embodiment, as illustrated in FIG. 5, the drive mechanism 110 may be comprised of a plurality of drive mechanisms 112 disposed throughout the hoistway 114. Each mechanism 112 includes a machine 116 and one or more belts 118. The mechanisms 112 further include one or more transmissions 120 to transfer energy to belts 18 that are not directly connected to an output shaft 122 of the machines 116. As a result of the modularity of this embodiment, the height of the rise of the elevator system is not limited in the conventional manner. There is no traction rope or hydraulic cylinder to limit the maximum rise. In addition, as illustrated in FIG. 5, each module may extend across several landings 124 or some modules may only extend between adjacent landings 124, as required by the particular elevator application. In addition, each mechanism is associated with a counterweight 126.

During operation, the machine 123 of the first drive mechanism 125 is energized to propel the car 124 through the hoistway 114 and from belt to belt 118 within the first mechanism 125. The counterweight 128 associated with the first mechanism 125 moves in the opposite direction as the car 126. As the car 126 approaches the first belt 130 of the second module 132, the counterweight 128 approaches the opposite end of the first mechanism 125. The machine 134 of the second drive mechanism 132 is then energized such that the belts 118 of the second mechanism 132 may begin to carry the load of the car 126 as it engages the first belt 130 of the second mechanism 132. As with adjacent belts connected via a transmission, the rotation of the belts 118 of adjacent drive mechanisms 112 are synchronized to ensure a smooth transition from one mechanism 112 to the adjacent mechanism 112. Once the car is fully engaged with the belts 118 of the second mechanism 132, the machine 123 of the first mechansim 125 may be de-energized and the motion of the belts 118 of the first mechansim 125 stopped. By having the machines operate independently in this manner, the cost of operating the elevator system is minimized since only the drive mechanism that is propelling the car is energized except during transitions.

As an alternative to the independent operation of the drive mechanisms as shown in FIG. 5., each drive mechanism may be connected by a transmission to an adjacent module. In this configuration, the plurality of machines would operate jointly such that the driving power for the belts could be distributed throughout the hoistway or travel path of the car.

Although shown and described in FIGS. 1–5 as having a single engagement between the car and belts, it should be apparent to one skilled in the art that multiple engagements may be used. An example of such a configuration is to have a first plurality of belts engaged with one side of the car, and a second plurality of belts engaged with the opposite side of the car.

Although the invention has been shown and described with respect to exemplary embodiments thereof, it should be understood by those skilled in the art that various changes, omissions, and additions may be made thereto, without departing from the spirit and scope of the invention.

What is claimed is:

1. A passenger conveyor system having a car driven along a predetermined path by a drive mechanism, wherein the drive mechanism includes a plurality of sequentially connected belts and a machine, each of the belts being engageable with the car to move the car along a portion of the path, the plurality of belts including a first belt operationally engaged with the machine to drive the first belt, wherein each of the plurality of belts is operationally engaged with an adjacent belt by a transmission, and wherein each of the plurality of belts includes a friction surface that engages a complementary surface of the car to generate traction between the car and belt.

2. The passenger conveyor according to claim 1, wherein each of the plurality of belts includes a plurality of teeth extending outward from the belt, and wherein the car includes means to engage the teeth of the plurality of belts.

3. The passenger conveyor according to claim 1, wherein each of the plurality of belts includes a plurality of bulbous projections spaced along the length of the belt, and wherein the car includes means to engage the projections of the plurality of belts.

4. The passenger conveyor according to claim 1, wherein the transmission includes a gear mechanism that transfers energy between adjacent belts.

5. The passenger conveyor according to claim 1, wherein the transmission includes a synchronous belt extending between and engaged with adjacent belts to transfer energy between the pair of adjacent belts.

6. The passenger conveyor according to claim 1, further including a second machine and a second plurality of connected belts, each of the second plurality of belts being engageable with the car to move the car along a second portion of the path, the second plurality of belts including a first belt operationally engaged with the second machine to drive the first belt, and wherein each of the second plurality of belts is operationally engaged with an adjacent one of the second plurality of belts by a transmission.

7. The passenger conveyor according to claim 6, wherein the first machine and the second machine are independently operated such that each machine may be shut down when the car is not traveling through the portion of the path associated with that machine.

8. The passenger conveyor according to claim 1, wherein the path of travel for the car is oriented in a vertical direction.

9. The passenger conveyor according to claim 1, wherein the path of travel for the car is oriented in both a vertical direction and a horizontal direction.

10. The passenger conveyor according to claim 1, further including a counterweight that travels along a predetermined counterweight path, the counterweight being engageable with each of the plurality of belts.

11. The passenger conveyor according to claim 1, further including an engagement means disposed on the car, the engagement means adapted to engage the plurality of belts, wherein the separation between adjacent belts defines a gap that extends a predetermined distance in the direction of travel of the car, and wherein the engagement means extends a distance in the direction of travel greater than the gap.

12. The passenger conveyor according to claim 1, wherein the passenger conveyor is disposed in a hoistway having a plurality of landings, and wherein each of the plurality of belts extends between two adjacent landings.

13. The passenger conveyor according to claim 1, wherein each of the plurality of belts includes a plurality of equally spaced projections that define means to engage the car, and wherein the location of the projections on one belt is synchronized with the location of the projections on the adjacent belt such that the projections engage the car smoothly during the transition of the car from one belt to the adjacent belt.

14. The passenger conveyor according to claim 6, wherein the first plurality of belts move the car is a vertically oriented direction and the second plurality of belts move the car in a horizontally oriented direction.

15. The passenger conveyor according to claim 10, further including a second counterweight disposed for travel along the counterweight path.

16. The passenger conveyor according to claim 7, further including a first and second counterweight, the first counterweight engaged with the first plurality of belts for movement through a first predetermined counterweight path, and the second counterweight engaged with the second plurality of belts for movement through a second predetermined counterweight path.

* * * * *